US005542999A

United States Patent [19]

Bucerius et al.

[11] Patent Number: 5,542,999

[45] Date of Patent: Aug. 6, 1996

[54] GAS-GENERATING MIXTURE

[75] Inventors: Klaus M. Bucerius; Helmut Schmid, both of Karlsruhe, Germany

[73] Assignee: Fraunhofer Gesellschaft zur Forderung der angewandten Forschung e.V., Munich, Germany

[21] Appl. No.: 373,023

[22] Filed: Jan. 17, 1995

[30] Foreign Application Priority Data

Jan. 18, 1994 [DE] Germany ..... 44 01 214.4

[51] Int. Cl.[6] ..... C06B 31/00

[52] U.S. Cl. ..... 149/45; 149/88; 149/105

[58] Field of Search ..... 149/45, 88, 105

[56] References Cited

U.S. PATENT DOCUMENTS

| | | | |
|---|---|---|---|
| 2,604,391 | 7/1952 | Taylor et al. | 149/38 |
| 3,664,898 | 5/1972 | Taylor et al. | 149/41 |
| 3,936,330 | 2/1976 | Dergazarian et al. | 149/35 |
| 4,336,085 | 6/1982 | Walker et al. | 149/45 |
| 4,632,714 | 12/1986 | Abegg et al. | 149/2 |
| 4,931,112 | 6/1990 | Wardle et al. | 149/85 |
| 4,994,123 | 2/1991 | Patrick et al. | 149/2 |
| 5,145,535 | 9/1992 | Patrick | 149/109.6 |
| 5,198,046 | 3/1993 | Bucerius et al. | 149/61 |

FOREIGN PATENT DOCUMENTS 658643 10/1951 United Kingdom .

*Primary Examiner*—Charles T. Jordan
*Assistant Examiner*—John R. Hardee
*Attorney, Agent, or Firm*—Antonelli, Terry, Stout & Kraus

[57] ABSTRACT

A gas-generating mixture for rescue and air bag systems, as well as for rocket and tubular weapon drive systems comprises high nitrogen, low carbon fuels GZT, TAGN, NG or NTO, the cold and fast burning oxidizer $Cu(NO_3)_2*3Cu(OH)_2$ and a catalyst for reducing pollutant gases, accelerating the reaction and cooling formed by a pyrophoric metal or a pyrophoric alloy on a carrier.

14 Claims, 1 Drawing Sheet

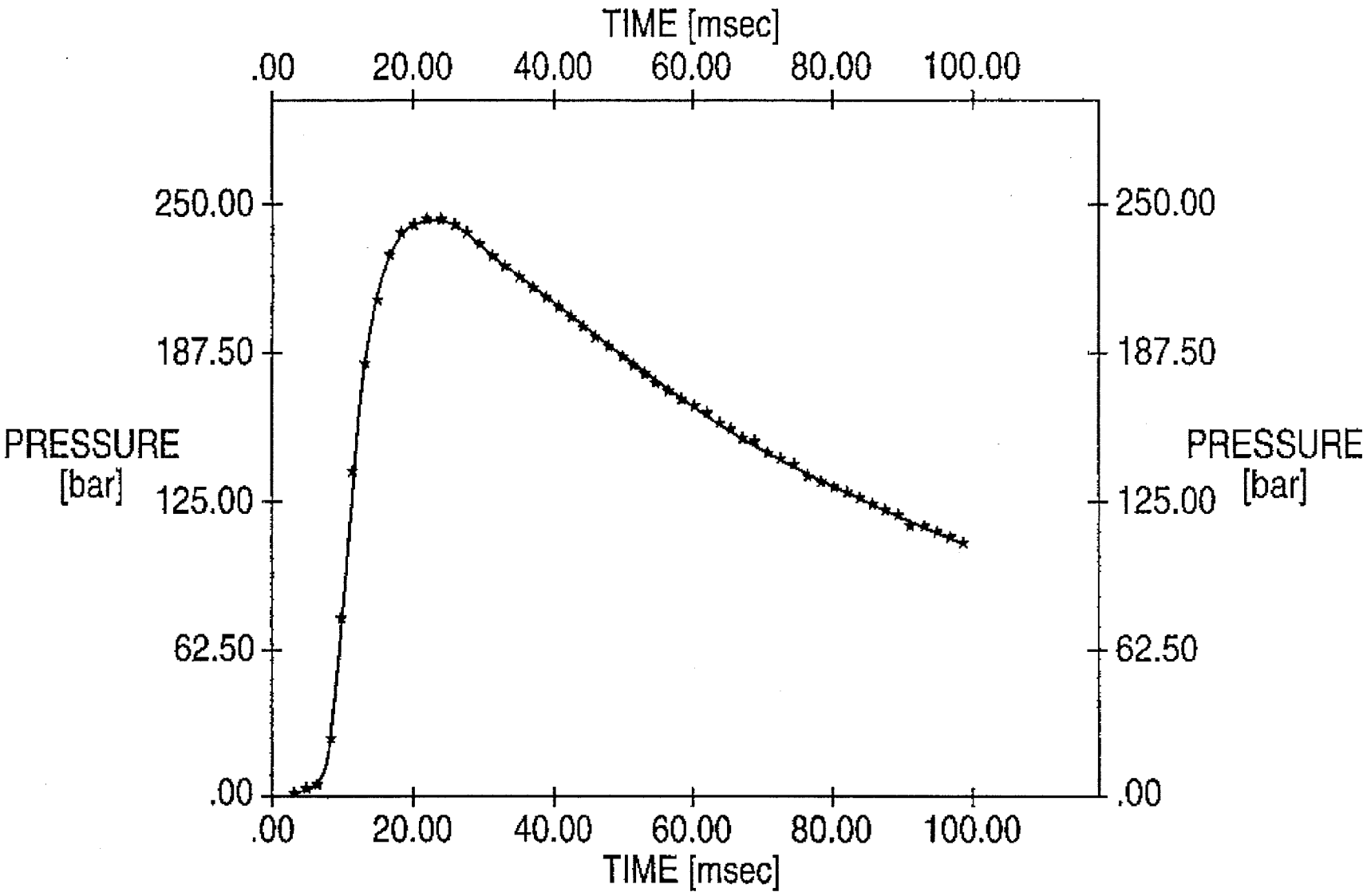
PRESSURE [bar]
250.00
187.50
125.00
62.50
.00
TIME [msec]
.00
20.00
40.00
60.00
80.00
100.00
PRESSURE [bar]
250.00
187.50
125.00
62.50
.00
TIME [msec]
.00
20.00
40.00
60.00
80.00
100.00

GAS-GENERATING MIXTURE

FIELD OF THE INVENTION

The invention relates to a gas-generating mixture of a fuel, an oxidizer, a catalyst and a coolant.

BACKGROUND OF THE INVENTION

Gas-generating mixtures of the aforementioned type, also known as gas generator sets, are characterized in that they permit a high gas output (>14 mole/kg) on combustion. They are used for rocket and tubular weapon drive systems, as well as for inflatable air bag and rescue systems. Particularly in the civil sector thermomechanical insensitivity and non-toxicity of the starting mixtures, as well as a lack of toxicity in the resulting gases is sought. Many systems in use do not or only very inadequately fulfil these requirements.

The reaction of these fuels with the hitherto used catalysts and oxidizers leads to an unsatisfactory gas composition and/or to an inadequate burn-up behaviour. In addition, many reaction mixtures have such a high combustion temperature that, for air bag applications, the thermally sensitive bag materials are damaged.

In the case of a mixture having the aforementioned structure, the problem of the invention is to lower the combustion temperature and raise the burn-up rate.

SUMMARY OF THE INVENTION

These fundamentally contradictory requirements are fulfilled, according to the invention, in that the oxidizer is $Cu(NO_3)_2*3Cu(OH)_2$ and the catalyst comprises a metal or a metal alloy on a carrier.

As a result of the oxidizer provided according to the invention there is a cold and rapid combustion. The maximum pressure is reached within milliseconds, the gas temperature remaining below harmful limits. The hitherto necessary slag-forming constituents, which are required in known systems for binding pollutants, e.g. alkali oxides, can be avoided in the mixture according to the invention, so that a higher gas output can be obtained.

The catalyst used according to the invention is mainly used for pollutant gas reduction (CO and NO), the term "catalyst" being understood in the wider sense of an active reaction component, which can itself be reacted and acts in a reaction-controlling and/or reaction-accelerating manner. The carrier serves to provide the main component with a large specific surface and a clearly defined particle size distribution. A further characteristic of the carrier is by physical and/or chemical processes, in a specific phase of the reaction, to develop a cooling action, which extends beyond a purely capacitive cooling action. The carrier can also act as a promoter of the main component. Not only the metal catalyst, but also the oxidizer are thermally and mechanically stable and in particular are not hygroscopic.

The catalyst is preferably a pyrophoric metal or a pyrophoric alloy on a carrier which, after burn-up is left behind as a solid. It can be a silicate, preferably a schist or framework silicate.

Silver has proved eminently suitable as the metal. Particularly in the case of civil applications non-toxic starting compounds and non-toxic reaction products are required. These requirements are fulfilled by fuels with a high N content and a low C content. These include the known fuels TAGN (triaminoguanidine nitrate), NG (nitroguanidine), NTO (3-nitro-1,2,3-triazol-5-one) and GZT (diguanidinium-5,5'-azotetrazolate) characterized by a particularly high nitrogen content (DE 4 108 225). Thus, when the mixture according to the invention is used for rescue and air bag systems preferably TAGN, NG, NTO and in particular GZT are used.

A preferred mixture consists of GZT and $Cu(NO_3)_2*3Cu(OH)_2$ with a compensated oxygen balance and up to 30 wt. % catalyst.

The coolant can be wholly or partly formed from $Fe_2O_3$, whose oxidative characteristics in the reaction mixture can be additionally used (DE 41 33 655, EP 0 536 525).

BRIEF DESCRIPTION OF THE DRAWING

The figure shows the behavior of pressure after ignition in the experiment described in the example.

EXAMPLE

A mixture of consisting of GZT, pyrophoric Ag on a schist or framework silicate carrier as the catalyst and $Cu(NO_3)_2*3Cu(OH)_2$ as the oxidizer is prepared in a ratio of 22.05:20.0:57.95 wt. %. With respect to its ignition and combustion behaviour this formulation was experimentally tested in a ballistic bomb. The enclosed pressure behaviour diagram was obtained, which shows that the mixture has good ignition and combustion characteristics. With a loading density of 0.1 g/cm$^3$ the maximum pressure is in the range 250 bar (25 MPa), which is reached after approximately 21 ms (t(pmax)=21 ms). The pressure increase time between 30 and 80% of the maximum pressure is $t_{30\text{-}80}$=4.35 ms.

The combustion temperature can be very accurately determined by thermodynamic calculation and is 2345K. For the same fuel GZT and compensated oxygen balance other oxidizers give higher combustion temperatures, e.g. 2501K for $KNO_3$, 2850K for $NH_4NO_3$ and 3248K for $KClO_3$.

We claim:

1. A gas-generating mixture comprising a fuel, an oxidizer, a catalyst and a coolant, wherein the oxidizer is $Cu(NO_3)_2*3Cu(OH)_2$ and the catalyst comprises a metal or a metal alloy on a carrier.

2. A mixture according to claim 1, wherein the catalyst is a pyrophoric metal or a pyrophoric metal alloy on a carrier.

3. A mixture according to claim 1, wherein the carrier for the metallic catalyst is a silicate.

4. Mixture according to claim 3, characterized in that pyrophoric silver on a schist or framework silicate carrier is used as the catalyst.

5. A mixture according to claim 1, wherein TAGN (triaminoguanidine nitrate), NG (nitroguanidine), NTO (3-nitro-1,2,3-triazol-5-one) or GZT (diguanidinium-5,5'-azotetrazolate) is used as the fuel.

6. A mixture according to claim 1 comprising a mixture of GZT and $Cu(NO_3)_2*3Cu(OH)_2$ with compensated oxygen balance and up to 30 wt. % catalyst.

7. A mixture according to claim 1, wherein the catalyst has an average particle size of <10 μm.

8. A mixture according to claim 1, wherein the coolant comprises $Fe_2O_3$.

9. A mixture according to claim 2, wherein the carrier for the metallic catalyst is a silicate.

10. A mixture according to claim 1, wherein the carrier for the metallic catalyst is a schist or a framework silicate.

11. A mixture according to claim 2, wherein the carrier for the metallic catalyst is a schist or a framework silicate.

12. A mixture according to claim 6, wherein the catalyst has an average particle size of 10 μm.

13. A mixture according to claim 5, wherein the coolant comprises $Fe_2O_3$.

14. A mixture according to claim 6, wherein the coolant comprises $Fe_2O_3$.

* * * * *